United States Patent [19]

Tucker

[11] 4,242,886

[45] * Jan. 6, 1981

[54] EARRING STAY

[76] Inventor: Mary Y. Tucker, 506 W. Bay View Dr., Sandusky, Ohio 44870

[ * ] Notice: The portion of the term of this patent subsequent to Feb. 20, 1996, has been disclaimed.

[21] Appl. No.: 42,054

[22] Filed: May 24, 1979

[51] Int. Cl.[3] ..... A44C 7/00

[52] U.S. Cl. ..... 63/14 B; 63/12

[58] Field of Search ..... 63/12, 13

[56] References Cited

U.S. PATENT DOCUMENTS

| | | | |
|---|---|---|---|
| 119,530 | 10/1871 | Northrup | 63/13 |
| 161,853 | 4/1875 | Baker | 63/13 |

*Primary Examiner*—F. Barry Shay

[57] ABSTRACT

An earring stay consisting of two parts resembling in structure a pierced earring and furnishing when mounted a platform at each surface of the ear lobe such that screw-on earrings can be clamped firmly against the platforms and will not exert their pressure on the lobe. The parts include a tube portion and a shaft portion which enter the pierced lobe and which are smooth inside and out. The male shaft fits snugly inside the hollow tube portion of its female counterpart protruding through the aperture in the lobe, and is held thus by vacuum, friction, or the pressure of an attached earring clasp.

1 Claim, 2 Drawing Figures

EARRING STAY

CROSS REFERENCES TO RELATED APPLICATIONS

U.S. Pat. No. 4,139,993, Protective Device for Receiving Earring Clamping Pressure, entitled "Earring Stay", issued to Mary Y. Tucker on Feb. 20, 1979.

Patent application pending, Ser. No. 034,577, filed Apr. 30, 1979, an Improvement on U.S. Pat. No. 4,139,993.

SUMMARY OF THE INVENTION

The previous patented Protective Device for Receiving Earring Clamping Pressure is a piece of jewelry similar to an earring in size, shape, and composition, but differing from a conventional earring in that the two sections, when inserted into the aperture of a pierced human ear lobe, and fastened together, form a comfortable platform on each side of the ear lobe. Screw-on earrings can then be securely anchored to these platforms and be worn for hours without discomfort or fear of losing an earring.

The Earring Stay consisted of two sections:

1. Female section "A" consisting of a hollow tube threaded on the inside, and connected at its closed end to a thin, circular disk, and smoothly rounded at its open end to permit easy insertion into the opening in a pierced ear lobe, from the front of the ear.

2. Male section "B" which screwed into the open end of female section "A" from the back of the pierced ear lobe, consists of a solid shaft threaded on the outside and connected to another thin disk at its closed end. This disk shaped platform of section "B" is provided with a means such as a circumferential lip, which prevents the screw clamp of a screw-on earring from slipping off the platform when an earring is attached to the earring stay already mounted in the aperture in a pierced human ear lobe.

The present Proposed Improvement on U.S. Pat. No. 4,139,993 simplifies the manufacturing process of the Earring Stay by eliminating the threading arrangement on both its male and female sections. An important objective of this improved arrangement is to further simplify the manufacturing process, thus conserving energy.

Another objective being that the simpler manufacturing process results in substantial cost reduction of the final product, bringing the Earring Stay within financial reach of a greater number of people.

DESCRIPTION OF THE DRAWINGS

Drawings of the new Improved Earring Stay accompanying this Patent Application show the two component parts.

DETAILED DESCRIPTION

Figure 1:
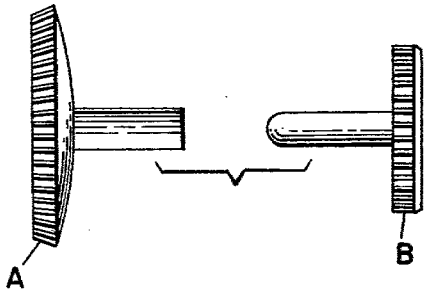
FIG. 1. Female Section "A" and male Section "B" as seen from the side.
Figure 2:
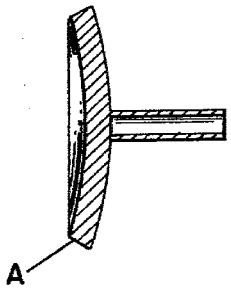
FIG. 2. A cross section of Section "A" showing the inside of the hollow tube portion of Section "A".

As revealed by the drawings, Section "A" (FIG. 1) shows a hollow tube approximately 1/10 centimeter in outside diameter, and approximately 5/20 centimeter long. The suggested 1/10 centimeter outside diameter of this tube is to keep it within the usual dimension of the aperture in a pierced human ear lobe. The free end of tube "A" is smooth and bevelled for ease in directing it through the ear lobe opening. The hollow space inside the tube portion (FIG. 2 section "A") is of sufficient diameter to allow the shaft of section "B" to be fitted inside the "A" tube. The closed end of tube "A" is attached to a thin circular disk which is slightly concave on its unattached outer surface. The total length of section "A" hollow tube and disk, is approximately 3/10 centimeter. The disk portion of section "A" is approximately 1/20 centimeter thick and 5/10 centimeter in diameter, and is smoothly serrated around its circumference for ease in handling.

Section "B" consists of a solid shaft about 5/20 centimeter long (actual length is left to the discretion of the manufacturer). The diameter of this shaft must be such as to allow it to be fitted inside the tube of section "A". The free end of male shaft "B" is smoothly rounded to prevent damage to the ear lobe if the shaft should slip while being introduced intothe tube of section "A". The closed end of the shaft of section "B" is connected to the center of a thin disk approximately 1/20 centimeter thick and 4/10 centimeter in diameter. This disk too is smoothly serrated around its outside circumference for ease in handling. And the outer surface of this disk has a saucer-like rim or lip around its outside circumference. The latter serving as a means for positively preventing the screw-on portion of a screw-on earring from sliding off the disk, once the earring has been tightly attached. The total length of the shaft and disk of male part "B" should stay within 3/10 centimeter, as the combined length of female part "A" and male part "B" when joined together, including the thickness of their disks should not exceed 7/20 centimeter. The 7/20 centimeter length of the joined Earring Stay parts is thus compatible with the usual distance between a screw-on ear ornament and its padded screw portion which pinches the screw-on earring to the ear lobe.

I claim invention of a new improvement on U.S. Pat. No. 4,139,993 for an Earring Stay device issued to Mary Y. Tucker, the applicant herein, on Feb. 20, 1979, as follows:

1. An earring stay comprising an article similar to an earring in size, shape and composition, said article including a female section having a tube with a smooth exterior surface and outer diameter adapting it for insertion into the aperture in the lobe of a pierced human ear, said tube having secured at one end thereof a platform adapted to overlie the external lobe surface adjacent one end of said lobe aperture and having its other end free with an opening at said free end; a male section having a shaft of a size to be received within said tube through said opening and having secured at one end thereof a platform adapted to overlie the external lobe surface adjacent the other end of said lobe aperture, said tube and shaft including coacting means which, when the sections are applied to a wearer's lobe, will permit a screw-on earring to be tightly attached to said earring stay without discomfort to the wearer, at least one of said platforms including means for positively preventing the movable part of a screw-on earring clamp from sliding off said one platform.

* * * * *